United States Patent [19]

Quay

[11] 4,408,371

[45] Oct. 11, 1983

[54] SELF-CLEANING DOFFER WIRE

[75] Inventor: Earl R. Quay, Orangeburg, S.C.

[73] Assignee: Mayer, Rothkopf Industries, Inc., Orangeburg, S.C.

[21] Appl. No.: 295,731

[22] Filed: Aug. 24, 1981

[51] Int. Cl.[3] ..... D01G 15/84

[52] U.S. Cl. ..... 19/114; 66/9 R

[58] Field of Search ..... 66/9 R; 19/105, 106 R, 19/114

[56] References Cited

U.S. PATENT DOCUMENTS

| | | | |
|---|---|---|---|
| 906,993 | 12/1908 | Bates et al. | 19/114 |
| 2,735,140 | 2/1956 | Fournier | 19/114 |
| 3,058,168 | 10/1962 | Laroche | 19/114 |

*Primary Examiner*—Louis Rimrodt

*Attorney, Agent, or Firm*—Harding, Earley, Follmer & Frailey

[57] ABSTRACT

Doffer wire for the card clothing of rotatable doffers used in carding heads for delivering fibers to the needles of a sliver high pile fabric knitting machine having improved fiber release characteristics. The doffer wires are constituted of a shank portion, which is embedded in cantilevered fashion in the card clothing, distal portions which are raked by the knitting machine needles to remove fibers therefrom, and bent or knee portions which connect the shank portions of the doffer wires to the distal portions thereof. The knee portions are formed with an angle greater than 130 degrees and less than 180 degrees, the preferred angle being on the order of 155 degrees.

3 Claims, 2 Drawing Figures

SELF-CLEANING DOFFER WIRE

BACKGROUND OF THE INVENTION

1. Field of the Invention

The present invention relates to doffer wires for use in card clothing. More particularly the present invention relates to doffer wires used in card clothing for doffers utilized in the sliver carding and feeding devices associated with high pile fabric knitting machines.

2. Description of the Prior Art

The prior art has known and used doffer wires as a part of the card clothing of the doffers in sliver high pile fabric knitting machines. The art has also recognized, for some time, that the ability to produce high quality sliver high pile fabrics is dependent on the ability of the knitting needles to remove the desired amount of fibers from the doffer wires. The failure of the knitting needles to remove the proper amount of fiber from the doffer wires not only results in a poor quality fabric but also results in a "dirty" doffer which can lead to additional quality problems and down time for the machine.

The doffer wire of the prior art generally comprises a shank portion and a distal portion which are connected by a knee portion having an angle no greater than 130 degrees. This prior art configuration has been found to be unsatisfactory for current sliver high pile knitting applications, as it has been found that some of the fiber will migrate from the distal portion of the doffer wire toward the shank portion. Thus, the doffer wire is not stripped of all the fiber and a fiber build up or accumulation results.

Formerly in sliver high pile knitting, the fiber or staple of which the sliver was composed was on the order of $1\frac{1}{8}''$ to $1\frac{1}{4}''$ in length. The fibers generally are cut from synthetic filaments and are relatively slippery with respect to each other. In order to ensure that the fibers of the sliver would hold during feeding to and carding at the knitting machine, the filaments from which the fiber staple was cut generally were crimped.

More recently, in order to reduce waste during finishing of the fabric, it has become the practice to use shorter fibers having a length on the order of $\frac{3}{4}''$. The reduction in fiber length has created two new problems. The first problem being that the shorter fiber length creates greater difficulty in holding the fibers together, both in the sliver rope fed to the carding heads and in the sheet formed on the carding heads as the slivers are fed to the knitting needles. This problem persists even though the fibers are crimped as in the former practice. The second problem created through the use of shorter fiber lengths is the difficulty of obtaining the same selected weight of fabric with the shorter fibers. A greater quantity of fibers must be fed to the needles in order to assure the same fabric weight. This means that there must be more individual fibers per square inch on the doffer to ensure more fibers per needle. This is accomplished by running the doffer at a slower rate, thereby providing a heavier build up of the sheet form of sliver fibers on the doffer wires. As a result of the increased build up, the needle hooks can take more fibers as they "rake" through the doffer wires.

While the former practice of using longer staple fibers sometimes led to a "dirty" doffer, the problem has been compounded with the shorter fibers currently in use. The problem is compounded both by the slower rate of running the doffer and by the use of cohesive agents which are employed to hold the shorter fibers together in the sliver form. The cohesive agent is not an adhesive but is a coating which causes the shorter fibers to cling together and maintain integrity in the sliver. The exact composition of the cohesive agents used is not known, as different mills use different cohesive agents in preparing the slivers and they are treated as trade secrets by the respective mills. However, it is known that the cohesive agents in conjunction with the shorter fibers and the required larger build up of fibers have compounded the problem of a "dirty" doffer.

The cohesive agents, while they are useful for the purposes of maintaining the sliver, make it difficult to rake the heavier concentration of sliver fibers from the doffer wires. The coated fibers tend to compact on the doffer wires and as a result of this cohesion are more difficult to rake. They tend to migrate or work their way into the knee portions of the doffer wires and cause a build up or jamming of fibers at the knee portions. The fiber build up in the knee areas of the doffer wires adversely affects the uniformity of the density of the pile in the fabric being knitted. In addition, the build up frequently causes needle breakage. Thus, in addition to unacceptable fabric there is machine down time to replace broken needles.

The present invention solves these difficulties by providing a doffer wire which is easily stripped by the knitting needle and has substantially no migrating fiber build up.

SUMMARY OF THE INVENTION

The present invention comprises a doffer wire or fillet wire having a shank portion which is inserted in cantilever fashion into the backing layers of the card clothing and a distal portion which is connected to the shank portion by a knee portion formed at an angle greater than 130 degrees.

DESCRIPTION OF THE PREFERRED EMBODIMENT

The preferred embodiment will be described in detail with reference to the attached drawing figures; like numerals identify like elements in all views.

Figure 1:
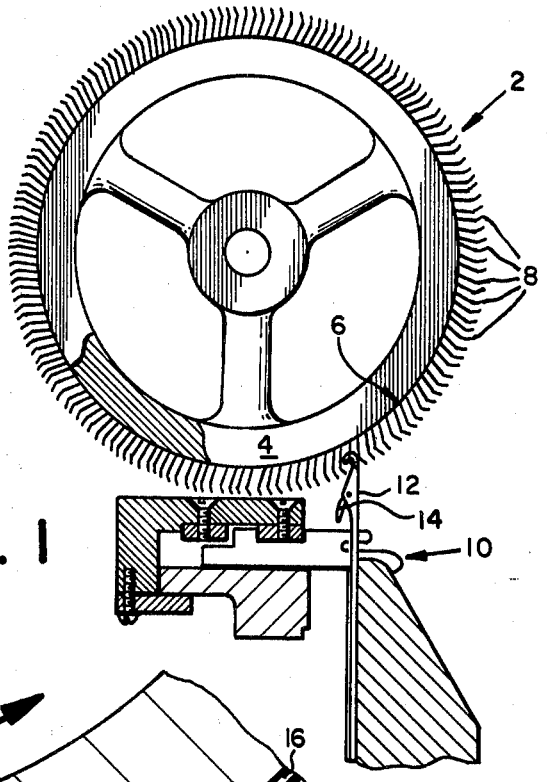
FIG. 1 is a fragmentary vertical section through a doffer, the sinker ring and a portion of the needle cylinder of a sliver high pile fabric knitting machine, the doffer being only partially sectioned and incorporating a preferred embodiment of this invention.

Referring now to FIG. 1, there is shown a doffer, generally designated as 2, which comprises a doffer cylinder 4 to which there is adhered card clothing 6. Extending outwardly from the periphery of the doffer cylinder 4 are a plurality of doffer wires or fillet wires 8 which are anchored in cantilever fashion in the backing layers of the card clothing 6. The doffer 2 is mounted in operative association with an open top circular knitting machine, generally referenced as 10. As will be known to those skilled in the art, such a knitting machine will have a rotatable circle of needles, and the single needle 12 shown in FIG. 1 is for illustration purposes only. Likewise, those skilled in the art will recognize that a multifeed knitting machine will have a plurality of sliver carding and feeding devices (not shown), each having a doffer 2 for delivering sliver fibers to the needles. The rotating knitting needle 12 will be presented to the doffer 2 with the latch 14 in an open position. The hook of the needle 12 will penetrate into the circumference defined by the distal portions of the doffer wires 8 and rake therefrom fibers carried by the doffer wires. The needle 12, with a tuft of fibers in its hook, will then begin its descent to the cast off level, taking in its tuft laden hook the yarn from which the base fabric is to be knitted before the latch 14 is closed. This manner of knitting pile fabrics is well known to those skilled in the art.

Figure 2:
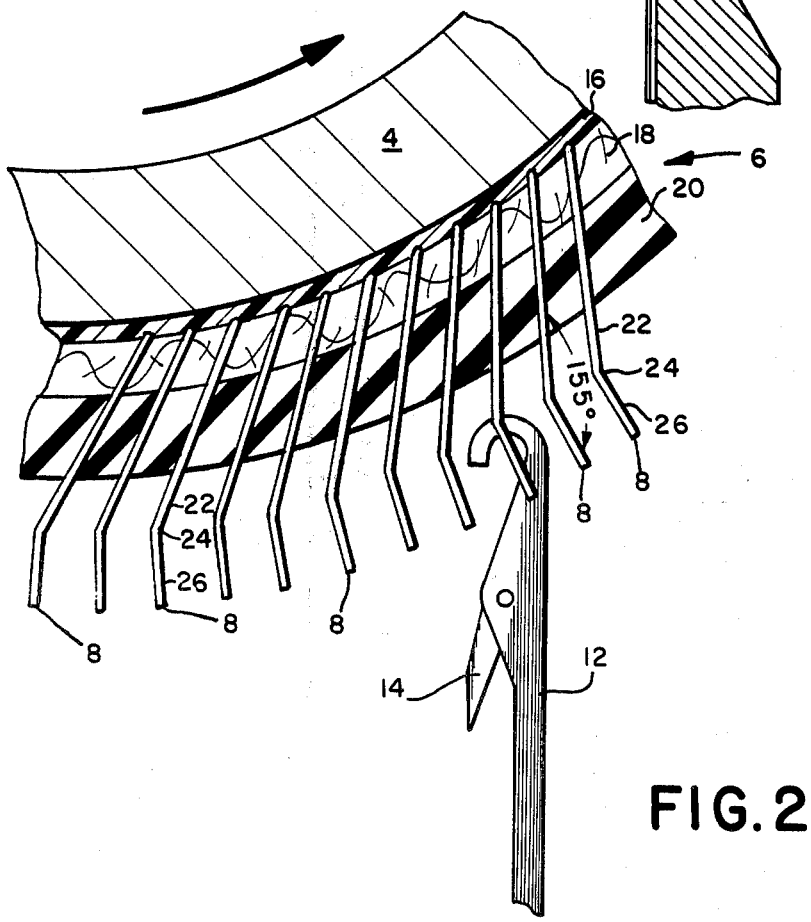
FIG. 2 is an enlarged fragmentary view of the knitting machine of FIG. 1 showing in greater detail the self-cleaning doffer wire of this invention.

Referring now to FIG. 2, the card clothing 6 is secured to the doffer cylinder 4 by means of a suitable adhesive or binder 16. Card clothing 6, as known in the art, is comprised of a first backing layer 18, generally of cotton, a second layer or face layer 20, generally of foam rubber, and a plurality of doffer wires 8. The doffer wires, which in the preferred embodiment are 33 gauge wires, for use in a 16 cut machine, as will be understood by those skilled in the art, are secured to the clothing by inserting the wires into the backing layers 18 and 20 in cantilever fashion. The shank portion 22 of each doffer wire 8 has the majority of its length imbedded in the layers 18 and 20. Each doffer wire 8 has a slight bend or knee portion at 24 and a distal portion at 26. The distal portion 26 is connected to the shank portion, in the preferred embodiment, by a knee portion having an angle of approximately 155 degrees.

As is known in the prior art, card clothing 6 is generally manufactured in strip form. The shank portion 22 is typically imbedded into the clothing in cantilever fashion such that the shank 22 is typically at a 70 degree angle with respect to the plane of the clothing.

It has been found that by increasing the angle of the knee portion 24 connecting the shank portion 22 and the distal portion 26, the fibers on the card clothing will tend to migrate toward the distal end 26 of the doffer wire 8. This tendency toward outward migration is opposite to that of previously used doffer wires, and tends to eliminate the build up of fibers on the exposed shank portion 22 while providing for a quick and easy release of the fibers to the hook of the needle 12.

While the preferred angle is approximately 155 degrees, it has been found that the benefits of the instant invention may be realized with doffer wires having angles greater than the standard angle of 130 degrees. In addition, it has also been discovered that doffer wires which were essentially straight or had an angle of 180 degrees were not acceptable as they would not transfer fiber from the main cylinder to the doffer. From the testing conducted to date, it is believed that the advantages of the instant invention are most fully recognized with doffer wires having the shank and distal portions connected by a knee portion having an angle in the range of 145 to 170 degrees.

It will be understood that various changes in the details, materials and arrangements of parts which have been herein described and illustrated in order to explain the nature of this invention may be made by those skilled in the art within the principle and scope of the invention as expressed in the following claims.

I claim:

1. Self-cleaning doffer wire for use in card clothing covering the periphery of a rotatable doffer for feeding relatively short fibers to the needles of a sliver high pile fabric knitting machine, said wire having shank portions embedded in a backing layer and extending outwardly of the doffer at an acute angle to the backing layer, said wires further having distal portions connected to the shank portions by knee portions, characterized by knee portions formed of an angle in the range of about 145° to about 170°, whereby fibers on the card clothing tend to migrate outwardly of the doffer toward the distal portions of the doffer wire to facilitate removal of substantially all fibers from the doffer by the needles as the needles rake the doffer wire.

2. The doffer wires of claim 1, characterized by a knee angle formed of approximately 155 degrees.

3. Doffer wires according to claim 2, characterized by shank portions extending from the card clothing at an acute angle of approximately 70 degrees.

* * * * *